United States Patent [19]

Suzuki et al.

[11] Patent Number: 4,936,754

[45] **Date of Patent: * Jun. 26, 1990**

[54] RECIPROCATORY PISTON TYPE COMPRESSOR WITH PARTITIONED DISCHARGE CHAMBER

[75] Inventors: Shinichi Suzuki; Chuichi Kawamura; Kazuhiro Nomura, all of Kariya, Japan

[73] Assignee: Kabushiki Kaisha Toyoda Jidoshokki Seisakusho, Aichi, Japan

[ * ] Notice: The portion of the term of this patent subsequent to Mar. 21, 2006 has been disclaimed.

[21] Appl. No.: 272,631

[22] Filed: Nov. 17, 1988

[30] Foreign Application Priority Data

Nov. 21, 1987 [JP] Japan ..... 62-294578

[51] Int. Cl.[5] ..... F04B 35/00; F04B 1/12

[52] U.S. Cl. ..... 417/269; 417/571

[58] Field of Search ..... 417/269, 271, 571

[56] References Cited

U.S. PATENT DOCUMENTS 4,534,710 8/1985 Higuchi et al. ..... 417/269
4,688,997 8/1987 Suzuki et al. ..... 417/222
4,813,852 3/1989 Ikeda et al. ..... 417/269
4,820,133 4/1989 Steele et al. ..... 417/571

*Primary Examiner*—Leonard E. Smith
*Assistant Examiner*—Robert N. Blackmon
*Attorney, Agent, or Firm*—Burgess, Ryan & Wayne

[57] ABSTRACT

A reciprocatory piston type compressor is provided with partition walls in a discharge chamber or chambers, the walls being arranged between discharge ports open to the discharge chamber, respectively, to prevent flows of refrigerant gas discharged from the discharge ports from directly interfering with each other at least during the time in which the opening of two adjacent discharge reed valves overlap one another. The partition walls may be formed integrally with a cylinder head of the compressor in such a manner that the partition walls extend centripetally from an inner wall surface of the cylinder head defining the discharge chamber. The flows of refrigerant gas discharged from the two adjacent discharge ports which are open will not interfere with each other but will be guided independently and centripetally along the partition walls in the discharge chamber toward the tops of the partition walls, and then toward an opening that leads to an outer discharge conduit.

7 Claims, 4 Drawing Sheets

RECIPROCATORY PISTON TYPE COMPRESSOR WITH PARTITIONED DISCHARGE CHAMBER

BACKGROUND OF THE INVENTION

1. Field of the Invention

The present invention relates to a reciprocatory piston type displacement compressor, such as a swash plate type constant displacement compressor having a swash plate mechanism on a drive shaft for reciprocating pistons in a plurality of axial cylinder bores disposed around the drive shaft, and a wobble plate type variable displacement compressor having an assembly of a rotatable drive and non-rotatable wobble plates on a drive shaft for reciprocating pistons in a plurality of cylinder bores disposed around one end of the drive shaft, to thereby compress a refrigerant in the cylinder bores.

2. Description of the Related Art

Generally, a swash plate type constant displacement compressor, such as the multi-cylinder swash plate type compressor disclosed in U.S. Pat. No. 4,534,710 to T. Higuchi et al., has a rotatable swash plate on a central drive shaft, double head reciprocatory pistons, each being disposed to straddle the periphery of the swash plate, and a plurality of cylinder bores formed in axially combined cylinder blocks to be disposed around the drive shaft in such a manner that the bores in the combined cylinder blocks are mutually axially aligned with one another to thereby receive the reciprocatory pistons.

A wobble plate type variable displacement compressor such as the variable displacement wobble plate type compressor disclosed in U.S. Pat. No. 4,688,997 to S. Suzuki et al., usually has a non-rotatable wobble plate on a central drive shaft, single head pistons connected to the wobble plate, and a plurality of cylinder bores formed in a cylinder block to be disposed around one end of the drive shaft to permit reciprocation of the pistons in the cylinder bores.

Due to an increasing demand for a compact but large displacement compressor the current main stream is a multi-cylinder compressor having five or more cylinder bores disposed around an axial drive shaft supported in the center of the compressor.

In the above-described reciprocatory piston type compressors, a fluid i.e., a refrigerant gas, is compressed in each cylinder bore and flows through a discharge port of a valve plate juxtaposed to an opening of the cylinder bore. The compressed refrigerant gas then pushes and opens a discharge reed valve to enter a closed discharge chamber defined in a cylinder head of the compressor.

The cylinder bores are circumferentially arranged at equal and relative small intervals in a cylinder block or blocks of the compressor. Therefore, before one discharge reed valve, which has been opened to permit the compressed refrigerant gas to be discharged from the cylinder bore, is restored to the closed position, an adjacent discharge reed valve is opened by the refrigerant gas compressed in the corresponding cylinder bore. Namely, an overlapping of the opening of two adjacent discharge reed valves occurs.

Since the discharge chamber is provided as a simple closed space for collecting the compressed refrigerant gas discharged from the respective cylinder bores and sending it toward the outside refrigerating circuit of the compressor, when the two different flows of the refrigerant gas discharged from the two adjacent currently open discharge ports enter the discharge chamber, the two flows of the compressed refrigerant gas generate fluid pressure waves which interfere with each corresponding respective flow within the discharge chamber. As a result, a problem arises in that this interference amplifies the pulsation of the discharged refrigerant gas before the compressed refrigerant gas flows into the outside refrigerant circuit. Also, a pressure difference always exists between the two adjacent currently open cylinder bores, and thus a refrigerant discharged from a later opened bore among the open cylinder bores may flow back into another cylinder bore which is to be closed, to lower the displacement efficiency of the compressor. Further, when each discharge reed valve is at a position just before a closure thereof, the valve is subjected to the complex actions of discharge pressures acting on both the upper and lower faces thereof, to thus aggravate the vibration of the reed valve.

SUMMARY OF THE INVENTION

An object of the present invention is, therefore, to obviate the above mentioned defects encountered by the conventional reciprocatory piston type compressor.

Another object of the present invention is to provide a reciprocatory piston type compressor provided with a discharge chamber or chambers having an improved internal structure, whereby the flows of compressed refrigerant gas discharged from adjacent cylinder bores of the compressor do not interfere with each other within the discharge chamber or chambers.

To accomplish the above objects, the present invention provides a reciprocatory piston type compressor provided with a discharge chamber having therein partition walls arranged between neighboring discharge ports opening to the discharge chamber, to thereby prevent a refrigerant gas flow discharged from one discharge port from directly interfering with the flow discharged from an adjacent discharge port.

Namely, in accordance with the present invention, there is provided a reciprocatory piston type compressor including a cylinder block having therein a plurality of axial cylinder bores disposed in parallel with each other and circumferentially arranged around a central bore of the cylinder block in such a manner that they are spaced from one another, reciprocatory pistons received in the plurality of cylinder bores respectively, a drive shaft rotatably supported in the central bore of the cylinder block, a piston reciprocating mechanism mounted on the drive shaft to cause reciprocation of the plurality of pistons in response to rotation of the drive shaft, a cylinder head closing the openings of the cylinder bores through a valve plate; a closed suction chamber for a refrigerant gas before compression and a discharge chamber for a refrigerant after compression, both chambers being defined in the cylinder, a plurality of discharge ports formed in the valve plate for providing a fluid communication between the discharge chamber and the plurality of cylinder bores when opened, and a plurality of discharge reed valves firmly attached to a valve retainer plate in the discharge chamber to successively open and close the plurality of discharge ports. The compressor is characterized in that a plurality of wall means is provided, each wall being disposed in the discharge chamber to extend between two adjacent ports of the plurality of discharge ports to thereby form a partition wall between the two adjacent discharge ports, each of the partition walls preventing the compressed refrigerant gas flows discharged from the two adjacent discharge ports from directly interfering with each other.

According to an aspect of the present invention, the partition walls are formed integrally with the cylinder head in such a manner that the partition walls extend centripetally from an inner face of a wall portion of the cylinder head, which portion defines the discharge chamber therein.

According to another aspect of the present invention, radially extending partition walls are integrally formed with a valve retainer plate in such a manner that the partition walls are disposed between respective retainer blade portions of the valve retainer plate that extend in a radially similar manner to the partition walls.

In all aspects of the present invention, the partition walls are constituted to prevent flows of refrigerant gas discharged from two adjacent discharge ports from interfering with each other at least in the valve opening zones of the discharge reed valves of the two adjacent discharge ports.

According to the present invention, compressed refrigerant gas flows discharged from discharge ports which are presently open can not interfere with each other but are guided independently and centripetally along the partition walls in the discharge chamber toward the tops of the partition walls and then toward an opening connected to a discharge conduit of a refrigerating circuit.

DESCRIPTION OF THE PREFERRED EMBODIMENTS

Figure 1:
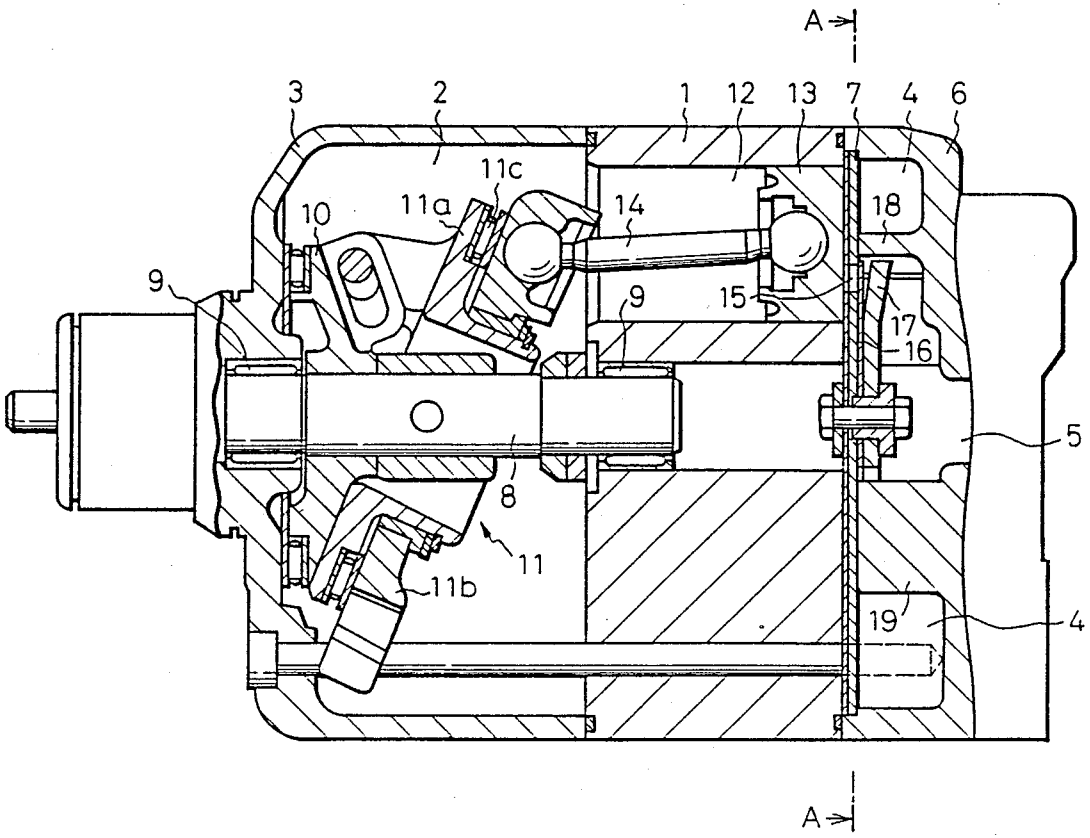
FIG. 1 is a partly broken front view of a wobble plate type reciprocatory piston compressor according to an embodiment of the present invention, illustrating an internal structure by sectioning a cylinder head along the line B—B of FIG. 2.

A wobble plate type reciprocatory piston compressor according to embodiment of the present invention will be described hereinbelow with reference to FIGS. 1 and 2. The compressor comprises a cylinder block 1, a crankcase 3 connected to a front end face of the cylinder block 1 and defining a crankcase chamber 2 therein, and a cylinder head 6 connected to a rear end face of the cylinder block 1 via a valve plate 7 and defining a suction chamber 4 and a discharge chamber 5 therein.

An axial drive shaft is rotatably supported between the cylinder block 1 and the crankcase 3 by a pair of rotative bearings 9. The drive shaft 8 has an outer end connectable, via a rotation transmitting mechanism, to, for example, a belt-pulley mechanism and a drive source (not shown) such as a car engine. A rotor 10 is mounted on the drive shaft 8 to be rotatable with the rotor 10, and provided with a known wobble plate assembly 11 having a rotatable drive plate 11*a* and a non-rotating wobble plate 11*b* held on the drive plate 11*a* by a rotative bearing 11*c*. In the cylinder block 1, a plurality of cylinder bores 12 (for example, six cylinder bores) are circumferentially and equiangularly arranged in parallel with each other to receive reciprocatory pistons 13, respectively. An end of a piston rod 14 of each piston 13 is connected to the non-rotating wobble plate 11*b*.

By rotating the drive shaft 8, the wobble plate assembly 11 carries out a wobbling motion to cause a reciprocation of the respective pistons 13. Then, in response to a difference in the pressure in the crankcase chamber 2 and a suction pressure (the pressure in the suction chamber 4), an angle of inclination of the wobble plate 11 with respect to a plane perpendicular to the axis of the drive shaft 8 is changed, i.e., a stroke of each piston 13 is changed, to thereby vary a displacement of the compressor.

Discharge ports 15 are formed in the valve plate 7 to communicate between respective cylinder bores 12 and the discharge chamber 5 of the cylinder head 6. The respective discharge ports 15 are openably closed by corresponding discharge reed valves 16. The discharge reed valves 16 are integrally formed from a piece of valve sheet to extend radially and are fastened to the valve plate 7 together with a valve retainer plate 17 that has substantially the same shape as that of the discharge reed valves 16.

Suction ports 15' (FIGS. 5 and 6) are also formed in the valve plate 7 to communicate between respective cylinder bores 12 and the suction chamber 4 of the cylinder head 6. The suction ports 15' are openably closed by corresponding suction reed valves (not illustrated).

Figure 2:
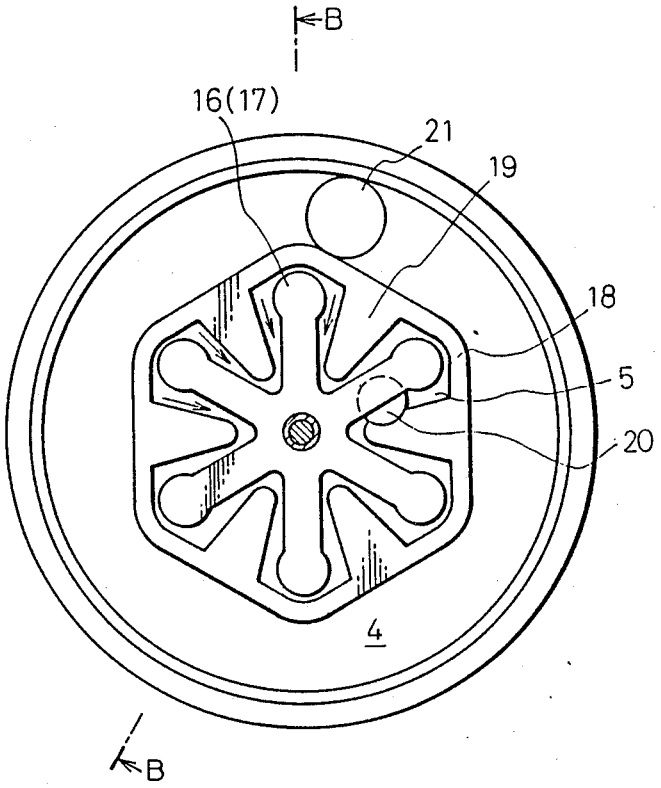
FIG. 2 is a sectional view taken along a line A—A of FIG. 1.

As best illustrated in FIG. 2, a closed space of the discharge chamber is defined by an annular wall 18 extending substantially in a hexagonal shape.

A plurality of radially inward extensions extending centripetally from the annular wall 18 between the respective discharge reed valves 16 are provided as partition walls 19 in the discharge chamber 5 to separate the adjacent discharge ports 15. The bottom surfaces of the partition walls 19 and the bottom surface of the annular wall 18 are brought into tight contact with the face of the valve plate 7 such that the flows of refrigerant gas discharged from the adjacent discharge ports 15 can not directly interfere with each other at least during the opening of both of the adjacent discharge reed valves 16.

Note, a gap may be provided between the upper surface of each partition wall 19 and the bottom face of the discharge chamber 5 opposed to the face of the valve plate 7.

The discharge chamber 5 is communicated with an outer discharge conduit (not shown) via an opening 20 illustrated in FIG. 2, and the suction chamber 4 is communicated with a suction conduit (not shown) via an opening 21 illustrated in FIG. 2.

The operation of the reciprocatory piston type compressor having the above-mentioned internal arrangement will now be described.

When the drive shaft 8 is driven by the drive source, e.g., a car engine, to rotate the rotor 10, the non-rotating wobble plate 11*b* of the wobble plate assembly 11 wobbles to cause a linear reciprocation of the pistons 13 via the piston rods 14. With a return stroke of each piston 13, a refrigerant gas is sucked from the suction chamber 4 into a corresponding one of the cylinder bores 12, and with a forward stroke of the piston 13, the sucked refrigerant is compressed to push the discharge reed valve 16 closing a corresponding one of the discharge ports 15 toward the opened position thereof, and therefore, the compressed refrigerant gas is discharged into the discharge chamber 5 through the open discharge port 15.

The six cylinder bores 12 are circumferentially disposed at equal and relatively small intervals in the cylinder block 1 so that, before one of the discharge reed valves 16 which has been brought to the opened position to discharge a flow of the compressed refrigerant gas into the discharge chamber 5 is fully restored to the closed position, a compression of refrigerant gas is carried out in the neighboring cylinder bore 12 to provide the refrigerant gas with a pressure sufficient to push against and open the discharge reed valve 16 of the adjacent cylinder bore 12, and thus a different flow of the refrigerant gas is discharged from the adjacent cylinder bore 12 into the discharge chamber 5. Nevertheless, the partition walls 19 in the discharge chamber 5 prevent the above-mentioned two flows of the refrigerant gas discharged from two adjacent discharge ports 15 from directly colliding with each other in an area adjacent to the open discharge ports 15 of the discharge chamber 5. Therefore, the flows of compressed refrigerant gas discharged from the neighboring discharge ports 15 do not interfere with each other but are guided independently and centripetally toward the top surfaces of the partition walls 19 in the discharge chamber 5 along the partition walls 19 in the direction of arrows shown in FIG. 2. Thereafter, both flows of refrigerant gas are joined together and sent from the opening 20 to the outer discharge conduit.

Figure 3:
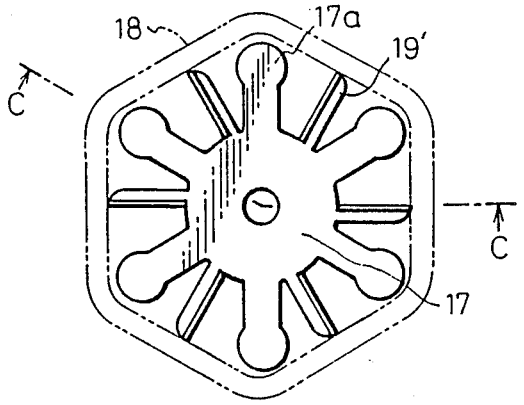
FIG. 3 is a side view illustrating a valve retainer plate according to another embodiment of the present invention.
Figure 4:
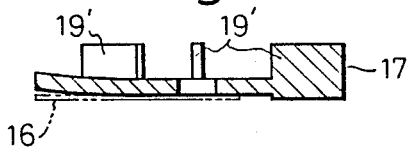
FIG. 4 is a sectional view taken along the line C—C of FIG. 3.

FIGS. 3 and 4 show another embodiment of the present invention. Namely, partition walls 19' of this embodiment, similar to the walls 19 of the afore described embodiment, are formed integrally with the valve retainer plate 17 in such a manner that the partition walls 19' extend radially between two adjacent radial retaining blades **17*a* which are located at the rear of the respective discharge reed valves 16. Each partition wall 19' has an appropriate height as best illustrated in FIG. 4. Accordingly, when the valve retainer plate 17 is arranged in the discharge chamber 5 of the reciprocatory piston compressor, the partition walls 19' functions in the same manner as the aforementioned partition walls 19, and therefore, the bottom surfaces of the respective partition walls 19' are in tight contact with the face of the valve plate 7, and the frontmost ends of the partition walls 19' are in tight contact with the inner face of the hexagonal annular wall 18 as illustrated in FIG. 3. As the function of the partition walls 19' is the same as that of the partition walls 19**, a detailed explanation thereof will be omitted.

Figure 5:
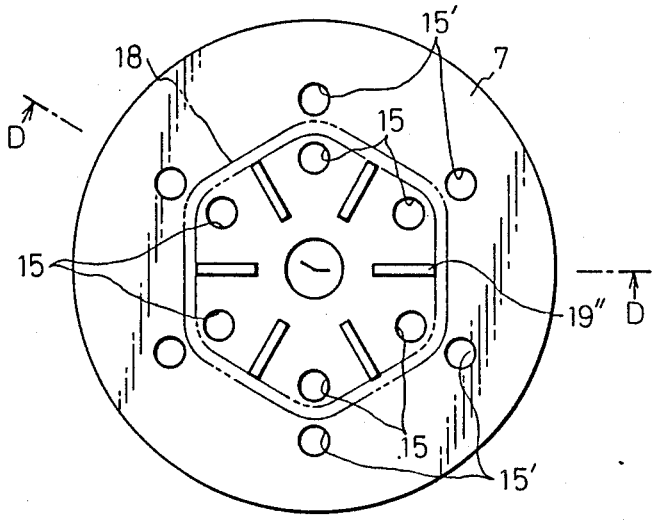
FIG. 5 is a side view illustrating a valve plate having partition walls according to a further embodiment of the present invention.
Figure 6:
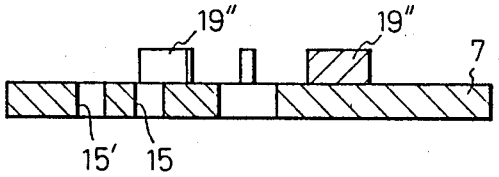
FIG. 6 is a sectional view taken along the line D—D of FIG. 5.

FIGS. 5 and 6 show a further embodiment of the present invention. In the embodiment of FIGS. 5 and 6, a plurality of rectangular partition walls 19'' (the number of the walls 19'' corresponds to that of the cylinder bores.) are formed integrally with the valve plate 7 in such a manner that, when the valve plate 7 is arranged between the cylinder block 1 and the cylinder head 6, the partition walls 19'' extend radially to provide a spatial separation between two adjacent discharge ports 15.

In the above-mentioned embodiments, the discharge chamber 5 is arranged at a central portion around an axis of the cylinder head 6, and the suction chamber 4 is arranged around the discharge chamber 5. Conversely, the discharge chamber 5 may be arranged at the peripheral position. In this case, the partition walls 19 will extend centripetally from the inner surface of the outer wall of the cylinder head 6. Further, a pair of the partition walls 19 may be arranged on both sides of each discharge port 15 which is open to the discharge chamber 5.

Although not illustrated in the drawings, according to one modification of the present invention, the partition walls having the above-described function may be formed integrally with a valve plate.

In summary, a reciprocatory piston type compressor according to the present invention has partition walls disposed between discharge ports open to a discharge chamber, respectively. The partition walls prevent flows of refrigerant gas discharged from adjacent discharge ports from directly interfering with each other, and therefore, pressure waves of the refrigerant gas discharged from the adjacent discharge ports do not directly interfere with each other, and thus pulsation of the discharged refrigerants is not amplified. Further, due to the provision of the partition walls, a flow of the refrigerant gas discharged from one cylinder bore is prevented from immediately flowing into another cylinder bore, and as a result, the problems and disadvantages of the prior art compressor such as a lowering of the displacement efficiency and an aggravation of valve vibration, are eliminated.

We claim:

1. A reciprocatory piston type compressor including a cylinder block having therein a plurality of axial cylinder bores disposed in parallel with each other and circumferentially arranged around a central bore of the cylinder block in such a manner that they are spaced from one another, reciprocatory pistons received in said plurality of cylinder bores respectively, a drive shaft rotatably supported in said central bore of said cylinder block, a piston reciprocating mechanism mounted on said drive shaft to cause reciprocation of said plurality of pistons in response to a rotation of said drive shaft, a cylinder head closing openings of said cylinder bores through a valve plate; a closed suction chamber for a refrigerant gas before compression and a discharge chamber for a refrigerant after compression, both chambers being defined in said cylinder head, a plurality of discharge ports formed in said valve plate for providing a fluid communication between said discharge chamber and said plurality of cylinder bores when opened, and a plurality of discharge reed valves firmly fastened to a valve retainer plate in said discharge chamber to successively open and close said plurality of discharge ports;

wherein an improvement comprises a plurality of wall means, each being disposed in said discharge chamber to extend between two adjacent ports of said plurality of discharge ports to thereby form a partition wall between said two adjacent discharge ports, each of said partition walls preventing flows of compressed refrigerant gas discharged from said two adjacent discharge ports from directly interfering with each other.

2. A reciprocatory piston type compressor according to claim 1, wherein said partition walls comprise a plurality of spaced extensions formed integrally with a wall portion of said cylinder head which is formed to define said discharge chamber.

3. A reciprocatory piston type compressor according to claim 2, wherein said plurality of extensions are in tight contact with a face of said valve plate having said plurality of discharge ports.

4. A reciprocatory piston type compressor according to claim 2, wherein said plurality of extensions extend radially inward from said wall portion of said cylinder head.

5. A reciprocatory piston type compressor according to claim 1, wherein said partition walls are formed integrally with said valve plate.

6. A reciprocatory piston type compressor according to claim 1, wherein said partition walls comprise a plurality of extensions formed integrally with said valve retainer plate and arranged to be in tight contact with a face of said valve plate having said plurality of discharge ports.

7. A reciprocatory piston type compressor according to claim 6, wherein each of said plurality of extensions extends between two adjacent retainer blades or said valve retainer plate, said retainer blades being arranged in alignment with said plurality of discharge reed valves.

* * * * *